United States Patent [19]

Bowles et al.

[11] 4,392,758

[45] Jul. 12, 1983

[54] UNDERSCORE ERASE

[75] Inventors: David J. Bowles, Winchester, Ky.; Douglas E. Clancy, Austin, Tex.; Carl F. Johnson, Lexington, Ky.; Danny M. Neal, Austin, Tex.

[73] Assignee: International Business Machines Corporation, Armonk, N.Y.

[21] Appl. No.: 227,878

[22] Filed: Jan. 23, 1981

Related U.S. Application Data

[63] Continuation of Ser. No. 908,314, May 22, 1978, abandoned.

[51] Int. Cl.[3] ..... B41J 29/16

[52] U.S. Cl. ..... 400/697.1; 400/17; 400/279

[58] Field of Search ..... 400/17, 76, 279, 280, 400/290, 293, 306, 309, 347, 536, 537, 538, 697.1, 709, 709.1, 709.2

[56] References Cited

U.S. PATENT DOCUMENTS 3,346,086 10/1967 Cralle, Jr. et al. ..... 400/309 X
3,630,336 12/1971 Johnson et al. ..... 400/17
3,780,846 12/1973 Kolpek et al. ..... 400/697.1 X

*Primary Examiner*—Ernest T. Wright, Jr.
*Attorney, Agent, or Firm*—Laurence R. Letson

[57] ABSTRACT

The electronic controls for a typewriter disclosed herein allow the operator to erase a character using automatic erase capability such as disclosed in U.S. Pat. No. 3,780,846 and at the same time to remove any underscores associated with that character. When an underscore command is entered the memory which stores the code representing the characters typed is caused to be altered in its content to indicate upon the reading of that code segment that the character has been underscored and that the character must be erased along with the underscore. The apparatus accomplishes multiple erase cycles to remove the underscore and then the character. In proportional space mode of operation it is possible that multiple underscore erase cycles will be necessary to remove an underscore which is wider than the underscore type font on the type element.

1 Claim, 8 Drawing Figures

UNDERSCORE ERASE

This is a continuation of Application Ser. No. 908,314 filed May 22, 1978, now abandoned.

SUMMARY OF THE INVENTION

In order to accomplish the correction of information on a typing line in a typewriter where an error has been made and where the information to be corrected has been underscored, it is necessary to remove both the underscore and the character which is being corrected. This is particularly necessary in the situation where erasure is effected automatically upon the depression of the correction key on the typewriter keyboard since in this mode of operation it is possible to remove all characters in reverse order back to the erroneous character. The need for the removal of the underscore as well as the character is further necessitated because, in a typewriter having proportional space capability, the character inserted in place of the corrected character may not have the same width or escapement value and therefore, the underscore may not correspond to the word or line lingth as is desireable.

When an electronic memory is included in the typewriter for its operation and control, it is also advantageous to utilize an automatic erasing arrangement similar to that disclosed in U.S. Pat. No. 3,780,846 to Robert Kolpek et al, commonly assigned herewith.

The improvement over the techniques which are capable with such products as the IBM Memory Typewriter comes in that the electronic controls will automatically reposition the print carrier of the typewriter, erase the underscore and then erase the character upon the depression of the erase control key. In the event that the underscore does not correspond to the full width of a wide character such as a capital "W" or capital "M" in the proportional space mode of operation, the electronic controls reposition the carrier for a second underscore erase function to fully remove the underscore which has been applied under that letter.

In an underscore erase operation, the underscore beneath the character is first erased and then the character is removed by a second error correction cycle of the typewriter. The information as to the presence of an underscore is determined by checking one of the binary bits stored in memory representing the character on the typing line. Since all the bits in an eight bit byte are not utilized in the coding of the alphanumeric characters as they are coded from the electrical contacts on the typewriter keyboard and as processed by the processor, the eighth bit which is normally on or represented by a 1 is changed upon the underscoring of a character to an off or zero condition to indicate that that particular character has been underscored. This bit is changed in memory so that when an error correction or erase command is received and the character is read from memory for utilization in the error correction operation the eighth bit is sensed as a zero to indicate that that character has been underscored and thereby initiates an underscore erase routine in the typewriter to accomplish removal of the underscore.

OBJECT OF THE INVENTION

It is an object of this invention to remove the underscore and the character from a typed page in response to a single erase operation keyboard command.

It is another object of this invention to remove the underscore from a composite character and the character regardless of character and underscore width.

If is a further object of this invention to detect the presence of an underscore under a character and to remove it when commanded to remove the character.

A more complete understanding of the invention will be had from a reading of the detailed description to follow.

DETAILED DESCRIPTION OF THE INVENTION

Figure 1:
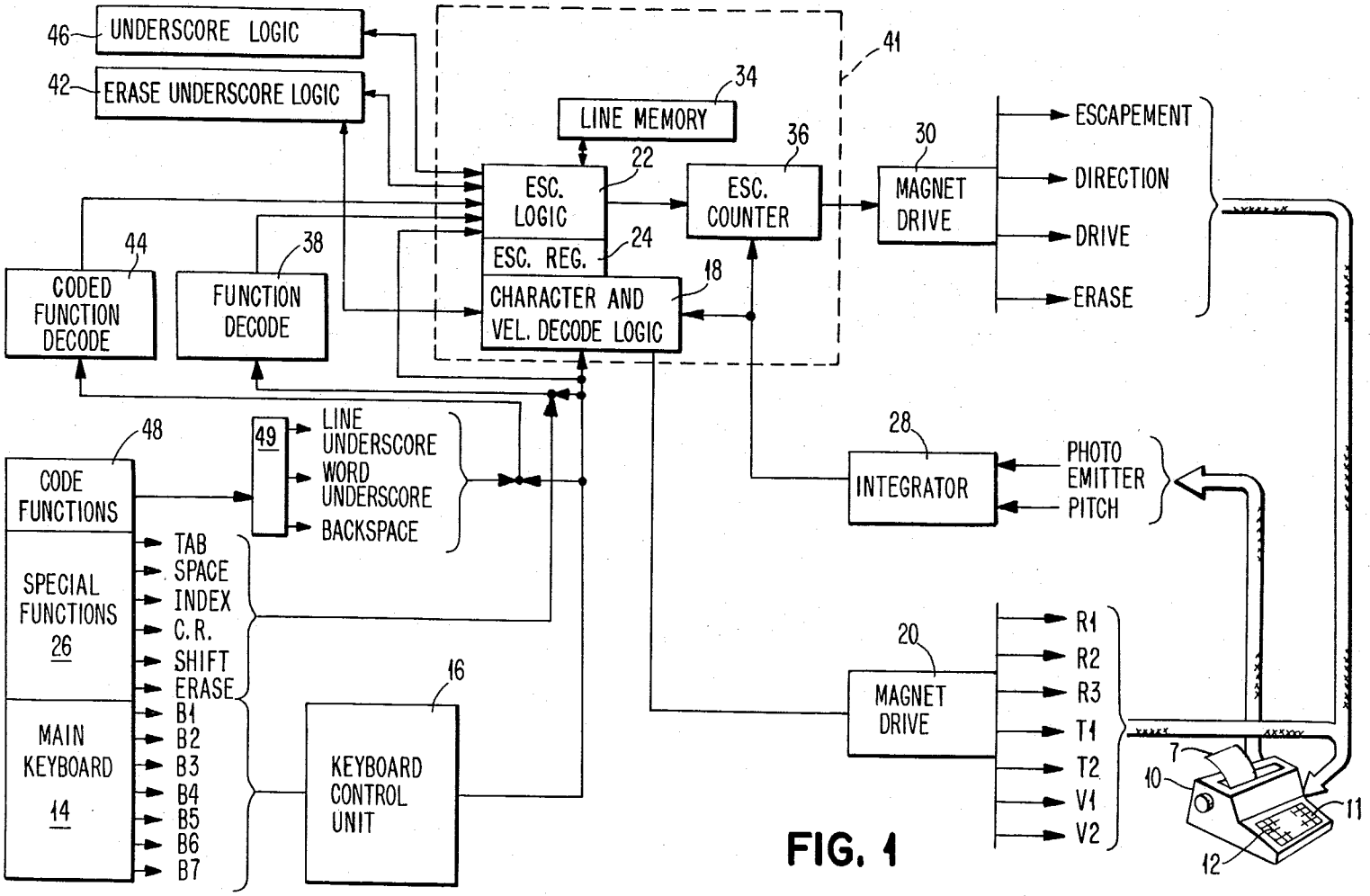
FIG. 1 illustrates the electronics in block diagram form which is capable of controlling the printer to accomplish underscore erase.
Figure 2:
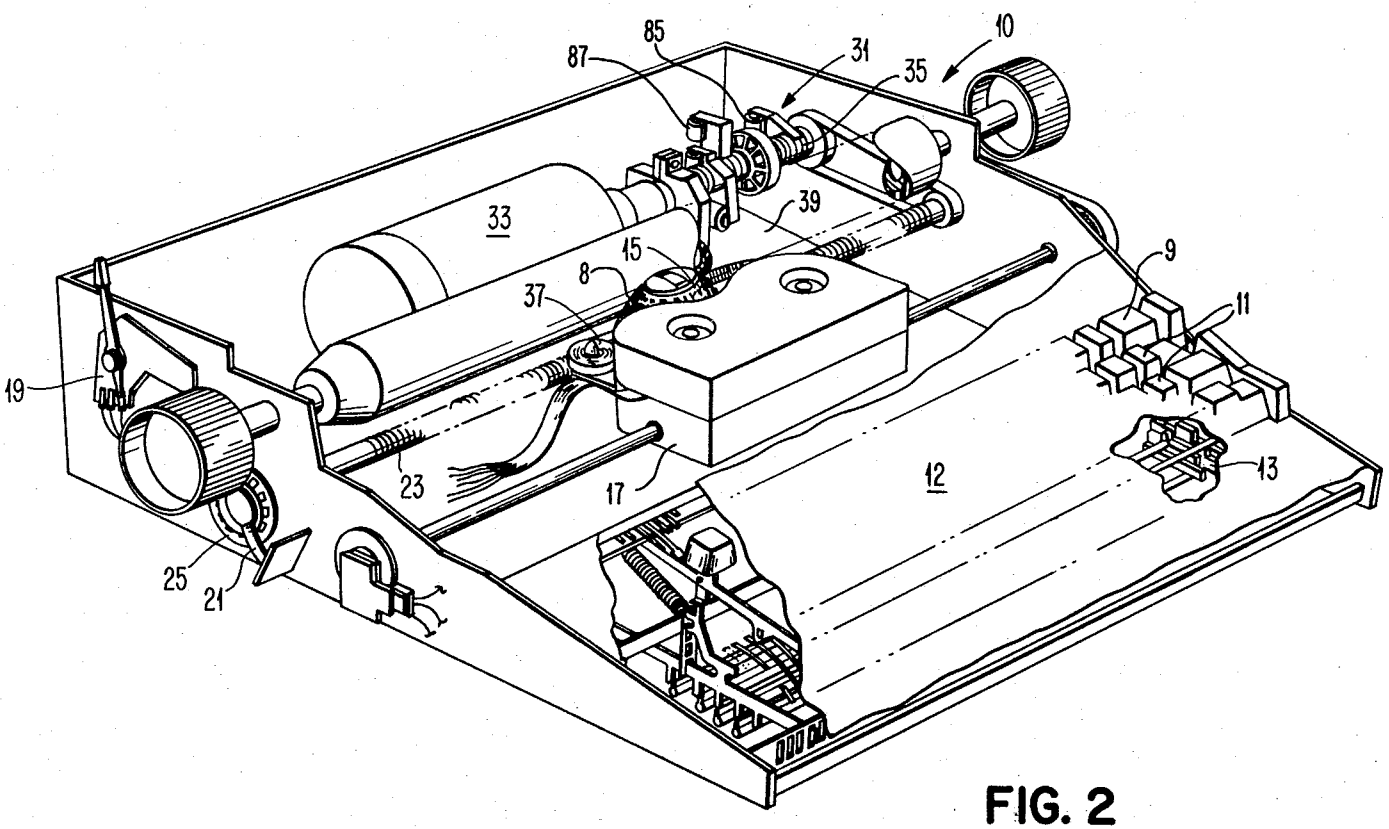
FIG. 2 illustrates the printer with the electronic inputs and outputs which interface with the electronics of FIG. 1.

Referring to FIG. 1, there is illustrated a typewriter 10 which is controlled by electronics in that the keyboard signals generated are processed electronically and the electronic controls therein then issue electronic commands to the printer to effect the appropriate functions of the printer elements to cause printing, escaping, backspacing, tabulation-correction and other normal printer functions. When a key 11 on the keyboard 12 is depressed to effect the selection of a character for printing, the keyboard 12 causes the switches 13 to close in a predetermined pattern thereby transmitting signals from the main keyboard 14 to the keyboard control unit 16. The keyboard control unit 16 captures the electronic inputs from the bail codes B1 through B7 and generates an appropriate strobe or control signal which then causes the total data signals to be transmitted to the character and velocity decode logic 18. The character and velocity decode logic 18 then converts the signals from the keyboard control unit 16 into signals which represent the position on the type element 15 of the character selected by the key lever depression. This is accomplished by converting the keyboard control unit 16 signal into input signals to magnet drivers 20 which then effect the rotation and the tilt of a single type element 15 or other conventional selection technique, to position the type font desired at the print point and then the selection of other controls, such as the velocity with which that type font is propelled toward the printed page.

The keyboard control unit signals are simultaneously read into the escapement logic 22 which then through a conventional table look up determines the assigned escapement values for each of the characters which are represented by the output of the keyboard control unit 16. These escapement values or width may be a standard width such as for example using a 1/60th of an inch per unit, 6 units for a 10 pitch escapement or 5 units for a 12 pitch escapement. Additionally with the escapement or characters being defined as units of 1/60th of an inch, it is possible to assign escapement values to characters proportional to their actual printing width, otherwise known as proportionally spaced characters. This thereby provides the capability of escaping the typewriter 10 responsive to the keyboard control signals and effecting proportionally spaced character printing.

The position of the carrier 17 or the print point of the typewriter 10 is constantly stored in the escapement register 24 which is a portion of the escapement logic 22, thereby providing a current location, measured from the left most point of travel of the carrier 17, and this value is constantly being updated as the carrier 17 translates left or right under the control of any of the keyboard signals. The escapement logic 22 outputs the width of the characters which have been selected at the keyboard 12 to the escapement counter 36. This is necessary to provide a control over the escapement functions of the printer. The escapement counter 36 then stores on a temporary basis the information necessary to control the translation of the print carrier 17 over a predetermined or preselected distance. The escapement counter 36 is controlled in its operation by the signals emanating from the integrator 28 which has signals going into it representing the output of the pitch selection switch 19 and the photoemitter/sensor 21 associated with the lead screw 23 and the escapement signal or emitter wheel 25 which indicates the portion of a complete rotation through which the lead screw 23 has been rotated. The pulses created by the photoemitter/-sensor 21 arrangement on the end of the rotatable lead screw 23 of the typewriter 10 effect the decrementing of the escapement counter 36. As long as the escapement counter 36 contains a numerical value, the photoemitter/sensor 21 will then pulse the escapement counter 36, through the integrator 28, and cause the escapement counter 36 to provide an output signal to the appropriate magnet drivers 30 to cause movement of the print carrier 17.

The escapement or movement of the print carrier 17 is a result of clutches 35 activated by signals emanating from the magnet drivers 30 which are provided their input from the escapement counter 36. The escapement signal, the direction signal, the drive signal and the erase signal all may emanate from the magnet drivers 30 which are controlled ultimately from the main keyboard 14. The escapement magnet driver 30 causes the release of the lead screw 23 and thus allows its rotation together with the emitter wheel 25 which interacts with the photoemitter/sensor 21 thus creating the signals discussed above. The direction magnet driver 30 controls the engagement of the clutches 35 in the drive unit to determine the forward or reverse direction of the carrier 17, by controlling the rotational direction of the lead screw 23. The direction magnet driver 30 provides the engagement or the coupling between the main drive motor 33 of the typewriter 10 and the lead screw 23, through the power transmission apparatus 31 or drive unit 31.

The erase magnet driver 30 controls the elevation of the erase tape 37 from the withdrawn position so that any subsequent printing effected by the type element 15 causes the impacting of the erase tape 37 against the page 7 to effect erasure, if the character being impacted was the same character as was previously impacted onto the printing ribbon 8 at that print point.

The printer control unit 41 contains the character and velocity decode logic 18, the escapement logic 22, the escapement register 24 and the escapement counter 36, and the line memory 34. As signals are decoded by the character and velocity decode logic 18 for subsequent utilization by the magnet drivers 20 for selection, that same information is temporarily stored in a memory designated as the line memory 34. This line memory 34 is capable of receiving the storable data and placing it into the line memory 34 in the sequence in which it has been received. The line memory 34 is capable of being read in reverse to determine characters which have been previously printed and machine functions which have occurred during that particular line of operation, such as the underscoring or space command.

Functions of the typewriter 10 are controlled by the function portion 26 of the keyboard 12. The functions which may be included in such a typewriter include underscore, tabulation, space, carrier return, shift and index. Of particular interest in this case is the underscore function. The underscore command is sent from the keyboard 12 as a series of electronic signals emanating from the switches 13 and are electronically shown as coded function 48. Block 49 illustrates that underscore and backspace signals all come from the coded functions section 48 and the keyboard control unit 16 contained in the keyboard 12. The function decode logic 38 determines which signal has been received and then passes that function decode logic output into the escapement logic 22. The escapement logic 22 receives the decoded function signals and determines whether any escapement function is involved.

In the case of word underscore, the characters are already stored in line memory 34 when the underscore command is keyboarded. This is due to the fact that the underscore command is keyboarded after the last character which the operator desires to underscore has been inserted, by way of the keyboard 12, into the printer 10 and the control logic 41, 46. Although the actual underscore command follows the text to be underscored in cases involving line underscore where more than one word and the intervening spaces are underscored, the keyboard 12 has been maniulated at the beginning of the underscorable text to indicate that that is the starting point for any subsequent line underscore command. This is accomplished by combining the coded function output and a predetermined and designated alphanumeric key 11 on the keyboard 12. Then the text to be underscored is typed and followed by the line underscore command. As a result of the line underscore command, the line memory 34 is searched for the "start of underscore" code or alternatively if the word underscore is the underscore command the memory 34 is searched for the next preceding space or tab which has been recorded into memory 34. During this reverse search operation for one of the codes which indicates a starting point for the underscoring, the eighth bit of each of the recorded characters, numerals or spaces, collectively referred to as graphics, is converted to a zero from the normal one condition. With the eighth bit of the code being turned off or converted to a zero, this will indicate on any subsequent functions where underscoring is partially or totally determinative, that the graphic has been underscored. Upon the finding of the start underscore, either recorded as a result of the line underscore command or upon the finding of the space or tab function referred to above, the graphics accumulated between the point of the entry of the underscore command and the start underscore code is then utilized to determine the distance through which the carrier 17 of the printer 10 must reverse escape. With this distance determined and entered into the escapement logic 22, and particularly the escapement counter 36, the printer is then caused to reverse tabulate or reverse escape to the start underscore position. The escapement register 24 has that location stored therein and the carrier 17 repositions itself over the start of underscore location.

As this point the underscore logic 46 will then command the escapement logic 22 to cause appropriate escapements and the character and velocity decode logic 18 to command the printing of underscores until the carrier 17 has returned to the position at which the underscore command was entered. The position at which the underscore command was entered is stored in the line memory 34 and the escapement logic 22 compares the carrier location, under the control of the underscore logic 46 with the position recorded in line memory 34. As long as that position is more than one underscore width distance from the print carrier position, another underscore function operation will be accomplished and the underscore printed, together with the appropriate escapement until the point at which the underscore command was entered is reached by the carrier 17. When an underscore operation is initiated the first character to be underscored may not be an integral number of underscore lengths from the end point of the underscore. If that is the case, the underscore logic 46 escapes the carrier 17 an amount after the first underscore print to align the carrier 17 an integral number of underscore lengths from the end of underscore location. This will cause a small overlap between the first and second underscore print marks but will accomplish the alignment on the last underscore character. This particular sequence is necessary where the text to be underscored has been printed in a proportional spacing mode of operation where each character may vary in width and escapement value. The realignment of the carrier 17 for the last impact of underscore is not necessary where the apparatus is being operated in a uniform pitch mode such as 10 or 12 pitch operation.

CHARACTER ERASE

If it is desired to return the carrier 17 to some point in the line and erase a character which has been underscored, it being immaterial whether it be the immediately preceding character or one earlier in the line where all characters are to be removed back to the erroneous character, the erase command is accomplished by the depression of the erase key 9 on the typewriter, keyboard 12, special function section 26. When the erase key 9 on the typewriter keyboard 12 is depressed a signal emanates from the special function portion 26 of the keyboard 12 to the function decode logic 38. The function decode logic 38 then determines that an erase function has been keyed. The outputs from the function decode logic 38 are fed into the escapement logic 22 which causes the line memory 34 to be read in reverse order to determine the escapement value necessary to reposition the printer carrier 17 over the appropriate print point for correction. At the time that the line memory 34 is read to determine the character and therefore the escapement value, the escapement logic 22 detects the eighth bit condition being a zero or off condition. This causes the escapement logic 22 to divert control to the erase underscore logic 42. The erase underscore logic 42 then issues a series of electronic commands through the escapement logic 22 to cause the type element 15 and print carrier 17 to reverse escape to position the carrier 17 over the print position occupied by the character to be removed. This is accomplished by loading the escapement counter 36 with the number of escapement increments corresponding to that character width and the escapement counter 36 then commanding the magnet drivers 30 for the escapement magnet 85, direction magnet 87 and the drive magnet 39, to reposition the carrier 17 in the reverse direction the requisite number of escapement increments. At the same time the escapement register 24 is loaded with the position of the new print point. The erase underscore logic 42 commands the character and velocity decode logic 18 to effect a selection of an underscore and to effect the printing of the underscore. This is accomplished by directing, to the magnet drivers 20, the appropriate rotate codes and velocity signals to effect the printing of the underscore. At the same time, as a result of the erase underscore logic 42 having controlled the escapement logic 22 and the escapement counter 36, the erase magnet driver 30 has been turned on to effect the positioning of the correction or erase tape 37 between the type element 15 and the page 7. Thus when the underscore is printed, it effects the erasure of the underscore. The erase underscore logic 42 control routine then causes the reading of the line memory 34 by the character and velocity decode logic 18 and the decoding of the character code stored in the line memory 34 to effect a second selection using rotate, tilt and velocity codes and the turning on of the appropriate magnet drivers 20 to effect the rotation and tilt of the type element 15. Codes controlling selection and printing are rotate signals R1, R2, R3, tilt signals T1, T2 and velocity signals V1, V2 coming from magnet drivers 20. The erase undersocre logic 42 also commands the escapement logic 22 and the escapement counter 36 to inhibit escapement on the next cycle but to turn on the magnet driver 30 effecting the raising of the erase tape 37. Thus upon the next machine cycle initiated by the erase underscore logic 42, this being the second complete machine cycle operated at the same print point, the character is then selected and the erase tape 37 positioned between the type element 15 and the print point on the page 7 thus effecting erasure of the character.

Should additional cycles be necessary to correct additional characters, the sequence is then repeated for each depression of the error correct or erase key 9 on the keyboard 12 or is continued until the erase key 9 is released after being held in a depressed position.

In the proportional spacing mode, when the line memory 34 is read to determine the character immediately preceding the print point, the escapement value for that character is determined and the print mechanism is reverse escaped, as described previously, though that escapement value or that number of escapement units corresponding to the character read from line memory 34. Thus it can be said that for narrow characters, a command to erase will result in the underscore type font on the type element 15 being impacted onto only a short portion of the underscore line with the right end thereof extending onto non-printed paper. This results in the engagement of the correction tape 37 with non-printed paper and has no visual effect of any substance. When a character is read which has a width or escapement value exceeding the width of the underscore, the escapement logic 22 determines that condition from the character and velocity decode logic 18 and inputs a signal to the escapement logic 22 to reverse escape the print carrier 17 a distance equal to the width of the underscore. It then commands an erase operation as described above wherein the erase tape 37 is positioned between the type element 15 and the page 7 and commands are conveyed from the character and velocity decode logic 18 to the magnet drivers 20 effecting the appropriate positioning of the type element 15 for the impacting of the underscore type font onto the erase tape 37 and the erase tape 37 then onto the printed page. Upon the completion of the erase cycle the erase underscore logic 42 then commands the escapement logic 22 to reverse escape any remaining value necessary to place the left end of the underscore type font at the left edge of the character.

At this point a second erase cycle, while selecting the underscore through the character and velocity decode logic 18, is accomplished thus removing a second small segment of underscore from the page 7. Also, at this point the type font and print mechanism are properly positioned so that the character which has been read from line memory 34 may then be selected by way of the character and velocity decode logic 18 to effect the selection of that type font and impacting onto the erase tape 37 and thence onto the page for erasure. As each character is read from the memory 34 the erase underscore logic 42 through the escapement logic 22 controls the escapement register 24 to reflect all intermediate positions of the print carrier 17 and print point through the multiple cycles. As the print carrier 17 is moved, the photoemitter/sensor 21 signals through the integrator 28 and acts to reduce the count in the escapement counter 36 and thus control the magnet drivers 30 which then in turn control the direction, drive and escapement magnets 87, 39, 85. In any cycle when the escapement counter 36 reaches a zero value, the escapement, direction, and drive magnet drivers 30 are turned off and the escapement logic 22 then releases the character and velocity decode logic 18 to perform the function of outputting signals to the selection magnet drivers 20.

Figure 3:
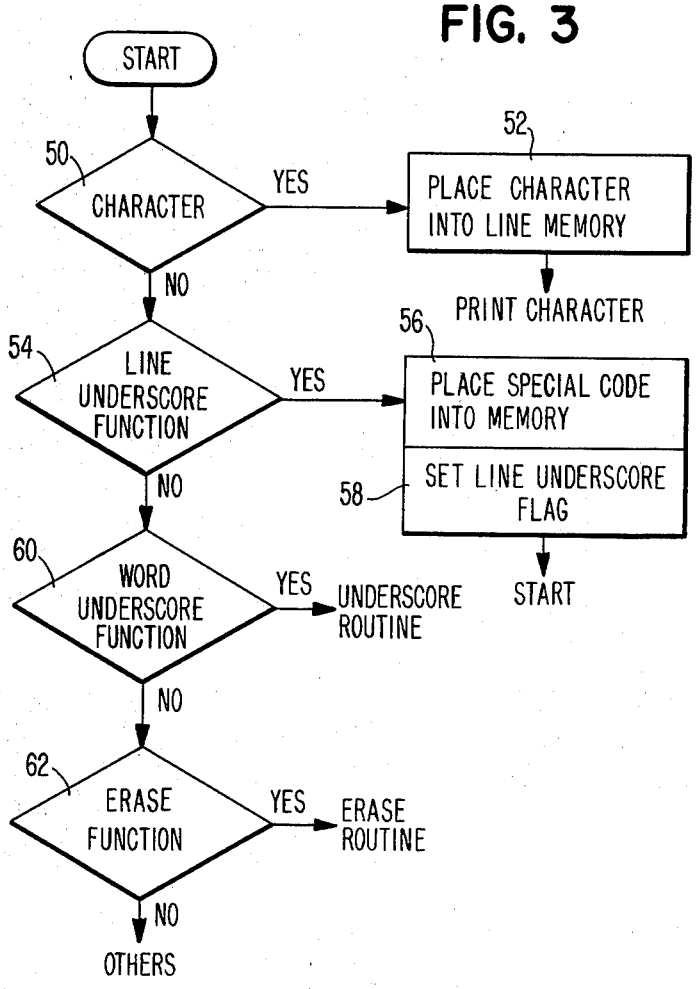
FIGS. 3 through 7 are flow diagrams of the logic flows performed by the logic represented in block diagram form in FIG. 1.

The controls necessary to control the typewriter 10 which have been explained above in block diagram form are preferably embodied in operational sequences of the electronic logic and devices which may be represented by the flow charts in FIGS. 3 though 7. To more fully understand the operational sequences and the logic controls which are a part of the block diagram illustrated in FIG. 1, refer to FIGS. 3 through 7. Referring to FIG. 3, the main flow of the logic contained in the underscore and underscore erase logic 46, 42 are illustrated in conventional flow chart form.

During normal typing operations it is from time to time necessary to cause words or lines of typed material to be underscored. It is also necessary, considering the occasional error made by a typist, to have the ability to correct errors made in underscored text.

Referring to FIG. 3 and the start point therein, it is assumed that typing is in progress. When a signal is received in the control logic 41 it is determined whether the signal which has been received is a character. If the code emanating from the keyboard control unit 16 to the character and velocity decode logic 18 is in fact a character (block 50), the routine will then branch by the "yes" route to cause the placing of the character into the line memory 34 (block 52). Upon the completion of the placing of that character into the line memory 34 (block 52) the routine will then flow to the print character sub-routine. The print character sub-routine will be explained later.

If the character and velocity decode logic 18 does not detect a code representing a character (block 50) then the logic flow branches through the "no" path to the question of whether the signal represents a line underscore function (block 54). In the event that the coded function decode 44 determines that the signal is a line underscore, the line underscore code is then stored in the line memory 34 (block 56). At the same time that the line underscore code is stored in the line memory 34, a line underscore flag (block 58) is set to indicate upon subsequent commands that the search back through the line memory 34 must be extended until the line underscore flag is encountered.

Upon the completion of the setting of the line underscore flag (block 58) the routine then branches back to the start of this flow path. In the event that the decision is made that there is no line underscore function (block 54) received by the coded function decode 44 the "no" path is followed to the decision block 60 in which the question is asked "is there a word underscore function being received?" If the answer to that question is "yes" then the flow path branches to the underscore routine, to be described more fully below. In the event that the answer to that decision is "no" then the flow passes through the "no" branch to the decision block 62 to determine if the function being received,by the coded function decode block 44 as illustrated in FIG. 1, is an erase function (block 62). If the code does represent an erase function (block 62) then the flow branches to the erase routine, FIG. 7. If the code is not that of an erase function, then the logic flow branches to other routines of the electronics which are not material to this invention.

Figure 4:
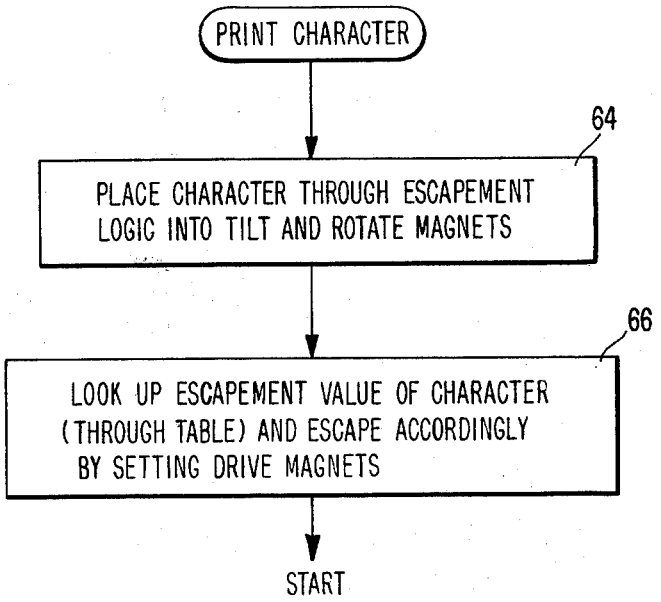

In the event that the code received by the character and velocity decode logic 18 represents a character (block 50) and that the logic flow has branched through the storing of that character into line memory 34 as indicated in FIG. 3 and described above and that the flow path is subsequently branched to the print character routine, the next function of the electronics is to place a code through the escapement logic 22 and into the character and velocity decode logic 18 to provide outputs to the magnet drivers 20 as shown (block 64) in FIG. 4. These magnet drivers 20 are representative of and control the rotation, tilt and velocity necessary to effect the printing of the selected character. Upon the completion of the signals being sent to the magnet drivers 20, the escapement value is then determined from an escapement table (block 66) and the value for that character is placed into the escapement counter 36 and the escapement register 24 is updated to indicate the destination of the carrier 17 and type element 15 upon the completion of the cycle. Upon the escapement counter 36 being loaded with the escapement value representing the character, the escapement direction and drive magnet drivers 30 are then turned on as a result of the escapement counter 36 being loaded and the carrier 17 is escaped. As the carrier 17, escapes, the photoemitter/sensor 21 together with the pitch selection switch 19 will provide feedback signals through the integrator 28 to the escapement counter 36 to reduce the count and at the same time provide a signal to the character and velocity decode logic 18. When the escapement counter 36 is decremented to zero as a result of the photoemitter/sensor pulses indicating movement of the carrier 17, the escapement counter 36 will turn off the magnet drivers 30 thus completing escapement.

Figure 5:
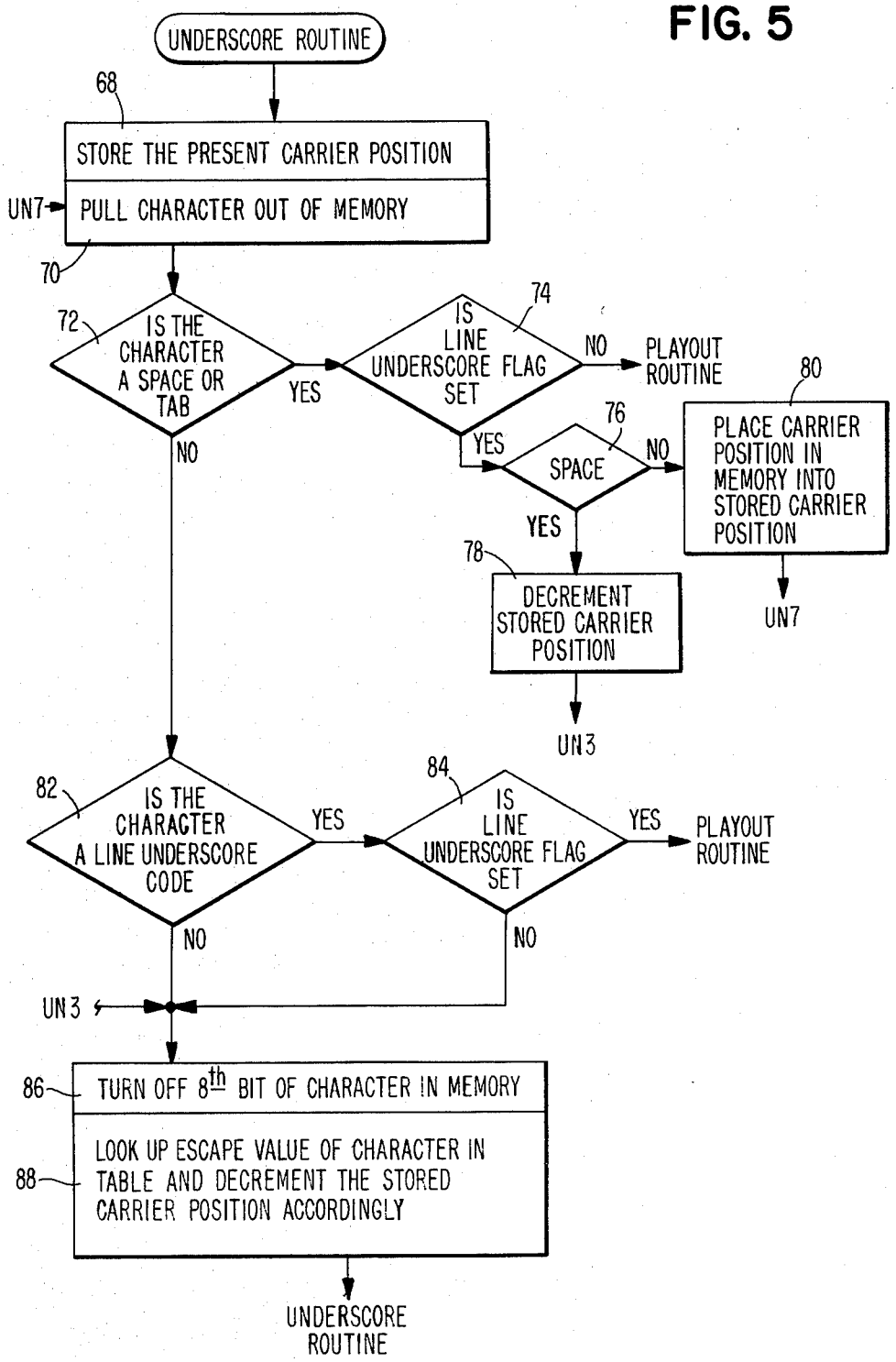

In the event that a word underscore function (block 60) has been detected by the coded function decode block 44 and as a result of the character and velocity decode logic 18 determining that there is no character being keyed at the keyboard 12, the flow branches to the underscore routine, as described with respect to FIG. 5. Upon the branching to the underscore routine, FIG. 5, the value in the escapement register 24, the present carrier position, is stored in memory 34 (block 68) for future use and the preceding characters in line memory 34 are then read (block 70). Then signals derived from the line memory 34 are processed by the underscore logic 46 to determine if the code or character being read from the line memory 34 is a space or tab code (block 72). If the code (block 72) is a space or tab code then the underscore logic 46 determines whether the line underscore flag has been set (block 74). If the underscore flag has not been set (block 74), then the process branches to the playout routine, FIG. 6.

If the line underscore flag has been set (block 74), then the logic 41 determines whether the code previously detected is a space (block 76). If the code does represent a space then the stored carrier position is decremented (block 78) an amount representing the space width (block 78). If the code represented is not a space, then it must be a tab command and in that case a carrier position, which was stored in line memory 34 at the time the tab command was initiated, is read into memory 34 as the stored carrier position (block 80) . Upon completion of the storage of that carrier position code, the routine then branches back to point UN 7 to repeat the cycle with respect to the next code immediately preceding in the line memory 34.

After the decision has been made that the code has been in fact a space code and the carrier position has been decremented by an amount equal to the space width, the routine then branches to UN 3 which will be more fully explained subsequently.

If the decision is made that the character being read from the memory 34 is not a space or tab code (block 72), then the logic flow branches to the decision block 82 where the question is raised "is the character a line underscore code?(block 82). " If the answer to that decision is "yes" then the logic checks to determine whether the line underscore flag is set (block 84). If the decision with respect to that question is "yes" the flow then branches to the playout subroutine to be more fully described below.

If the answer to that decision is "no" the flow will then branch to a path which is the same as if the character was not a line underscore code in decision block 82. At this point, the logic flow has determined that the code is not a space, tab, or line underscore code. If that condition exists then the code being read from the memory 34 must of necessity be an alpha or numeric character. Thus the eighth bit of that character code is turned off or conditioned to a zero state in memory 34 (block 86). The escapement value is then determined from the table look up and the stored carrier position is decremented that escapement value and restored in memory 34 for future manipulation (block 88). At this point, the underscore routine is then repeated with respect to each character position until such time as the routine goes to the playout reoutine, which only occurs upon the discovery of a space or tab or a line underscore code with the line underscore flag being set appropriately.

Figure 6:
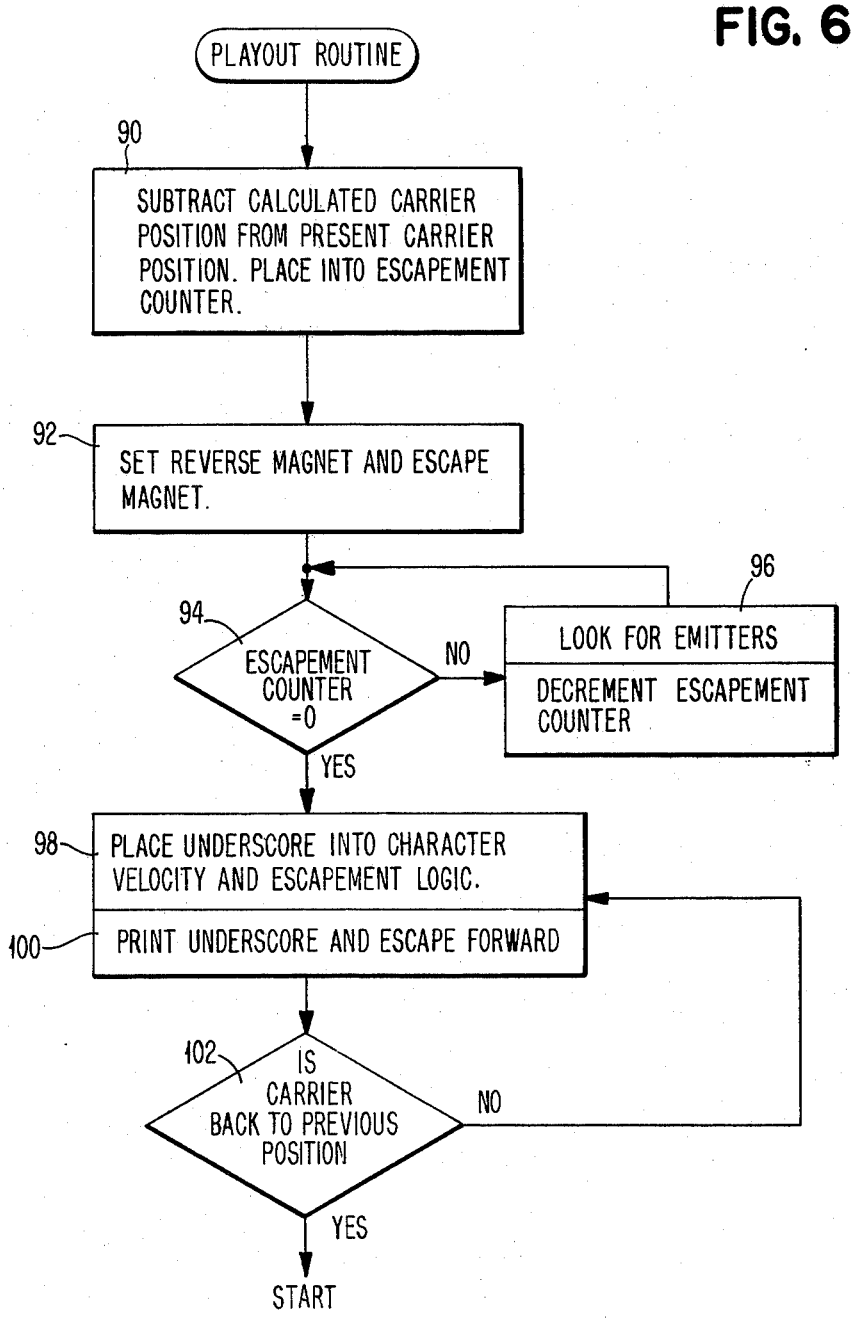
Figure 7:
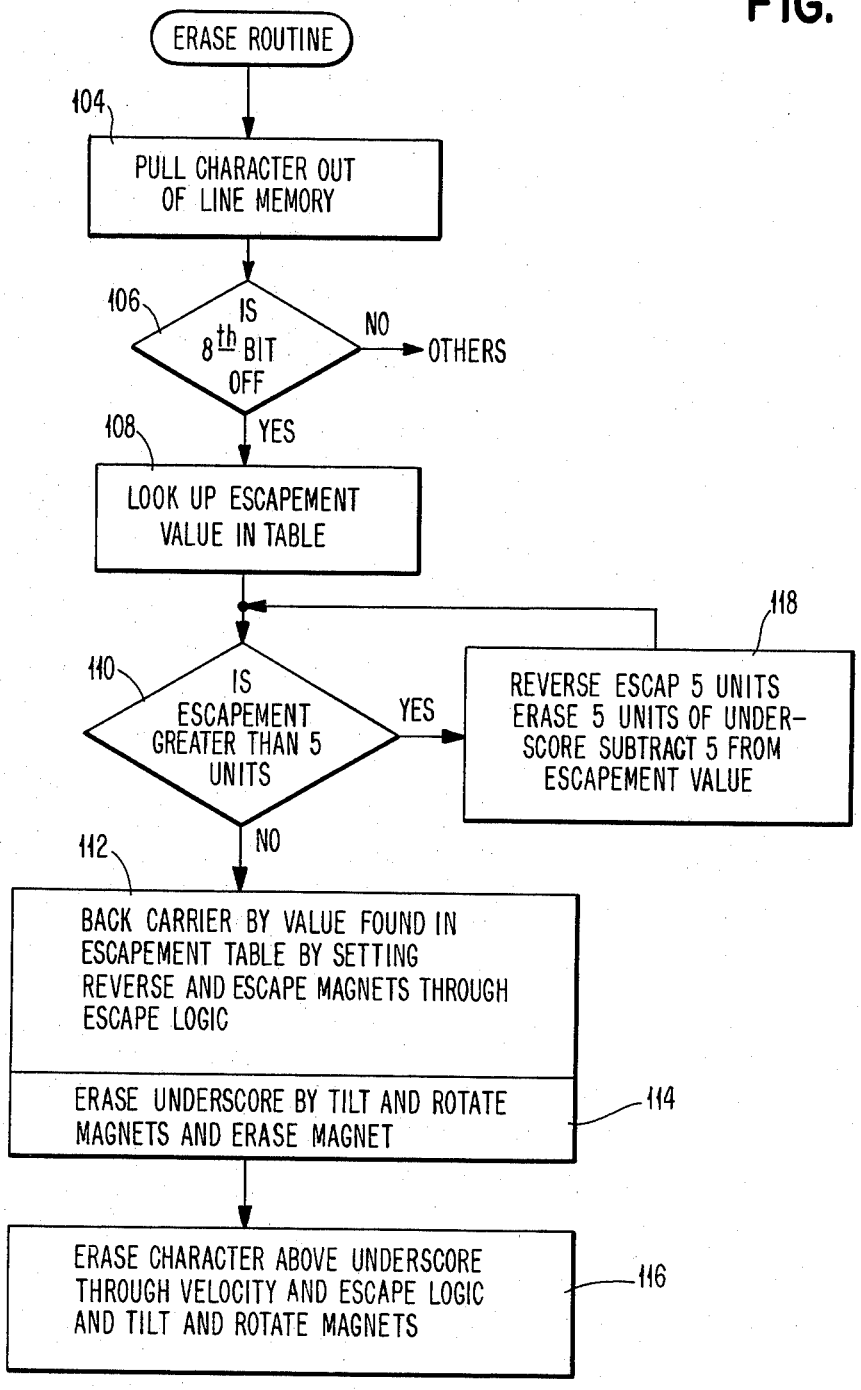

Referring now to FIG. 6, which represents the playout routine referred to immediately above, upon the satisfying of the conditions required as described above and illustrated in FIG. 5, the routine will branch to the playout routine. As was described earlier with respect to FIG. 5, the underscore routine has calculated a position as it moves back through the memory 34 which will represent the position to which the carrier 17 must reverse escape before the starting of the actual underscoring of the characters. This position which has been determined as a result of the underscore routine is referred to as the calculated carrier position. The playout routine represented by FIG. 6, starts by subtracting the immediately above referred to calculated carrier position from the position that the carrier 17 actually occupies, that beiing the present carrier position at the end of the text to be underscored (block 90). The remainder of this subtraction operation is then placed into the escapement counter 36. The underscore logic 46 then causes the direction magnet 87 and the escapement magnet 85 to be turned on through the escapement counter 36 to effect reverse escapement (block 92). Upon each succeeding logic cycle, the escapement counter 36 is then compared with zero (block 94) and if the value of the escapement counter 36 is not equal to zero then the "no" path is followed and the escapement counter 36 continues to accept control pulses emanating from the photoemitter/sensor 21 to decrement (block 96) the value in the escapement counter 36. At this point, the logic path returns to the decision block 94 as the escapement counter 36 equals zero. As the escapement counter 36 is decremented it will eventually reach a zero value and the yes path is followed. At this point, the underscore logic 46 will then place a code into the character and velocity decode logic 18 to effect the printing of the underscore under the character (block 98). Upon the printing of the underscore mark under the character, the velocity and character decode logic 18 will then cause the normal escapement for the underscore character (block 100). The underscore logic 46 then will compare the carrier position upon the completion of the underscore print operation to the position which the carrier 17 occupied at the time that the underscore routine was entered (block 102). This position was stored in memory 34 at the beginning of the underscore routine for future comparison. If the carrier 17 is not at the same position, then the underscore logic 46 will cause the placing of another underscore code under the character and cause velocity decode logic 18 to effect printing and escaping as just previously described.

Upon the carrier 17 reaching the previous position, the decision will be made that the carrier 17 is at the previous position and the flow will branch from the playout routine back to start in FIG. 3.

In the event that an error has been made in the typing of a character prior to the underscoring or an underscore is placed in a position which the operator does not desire to have underscored, the erase routine may be entered as a result of the special functions 26 portion of the keyboard 12 indicating that erasure or correction is to occur. The function decode block 38 as illustrated in FIG. 1 will receive the erasure signal and read the next preceding character code in the line memory 34. Upon the function decode block 38 determining that there exists an erase command, the erase logic 42 will assume control and will check the code from line memory 34 (block 104) to determine if the eighth bit of that code is in an off condition or a zero state (block 106). If the eighth bit is not in an off position the routine will branch to other functions not relevant to the erase underscore routine. If the eighth bit is a zero or off, the "yes" path is followed and the escapement value is then determined for the character code received by the erase logic 42 from memory 34 (block 108). Upon the determining of the escapement value, it is then compared to the width value to determine if the escapement value is greater than 5 escapement units (block 110) which is the width of the underscore mark. If the escapement value of the character which has been read from the line memory 34 is less than or equal to 5 units the "no" path is followed and the carrier 17 is then caused to reverse escape, by substantially repeating the same operation as described earlier by the value of the escapement for character read from memory 34 (block 112). This reverse escapement is effected by the reverse escapement control of the escapement counter 36 and the reverse and escape magnets drivers 30 as controlled through the escapement logic 22.

Upon the completion of the escapement of the carrier 17 in the reverse direction to the designated position as immediately described above, the erase logic 42 and underscore logic 46 act through the character and velocity decode 18 and the escapement logic 22 to condition the erase magnet driver 30 and rotate magnet drivers 20 to effect the positioning of a correction tape 37 between the type element 15 and the page 7 and the appropriate selection of the underscore character and in then impacting of that character onto the erase tape 37 to cause the removal of the underscore from the page (block 114).

Upon the completion of the erasing of the underscore, the erase logic 42 causes the character code read from line memory 34 to be entered into the character and velocity decode logic 18 and controls the escapement logic 22 to effect the activation of the erase magnet driver 30 together with the selection of the character as controlled by the character and velocity decode logic 18 to cause the character to be erased (block 116).

If the escapement value of the character read from line memory 34 is greater than 5 escapement units, such as capital "W" and capital "M", then the flow will branch to cause the carrier 17 to reverse escape 5 units and erase 5 units of the underscore (the width of the underscore type font) (block 118). Then 5 will be subtracted from the escapement value of the character as determined from the escapement table and the flow will then branch back to the decision block "is the escapement value greater than 5 units?" 110. At this point the answer will be "no" and the sequence previously described will be followed.

The embodiment which this invention may take may be one of several alternatives forms. One form is described above in conjunction with the block diagrams and flow charts. An alternative embodiment may be an electronic processor control illustrated in FIG. 8 which may operate in conjunction with a permanently configured read only storage 128 in which a series of instructions and codes may be stored. This electronic apparatus would correspond to the apparatus as described in conjunction with FIGS. 1 and 3 through 7.

In such case, as an alternative to the flow diagrams illustrated in FIGS. 3 through 7, codes or commands may be stored in the read only storage 128 to cause the processor (FIG. 8) to process the information from the keyboard 12 and to control the printer in a predetermined sequence of steps. The commands and codes stored in the read only storage 128 may take the form of those attached in Appendix A and Appendix B. Appendix A is a listing of definitions which indentify and are associated with particular registers in the form of storage addresses within direct and indirect rams 122 and 124 or particular bits within a byte and equates those register designations and or bit designations with mnemonics.

Figure 8:
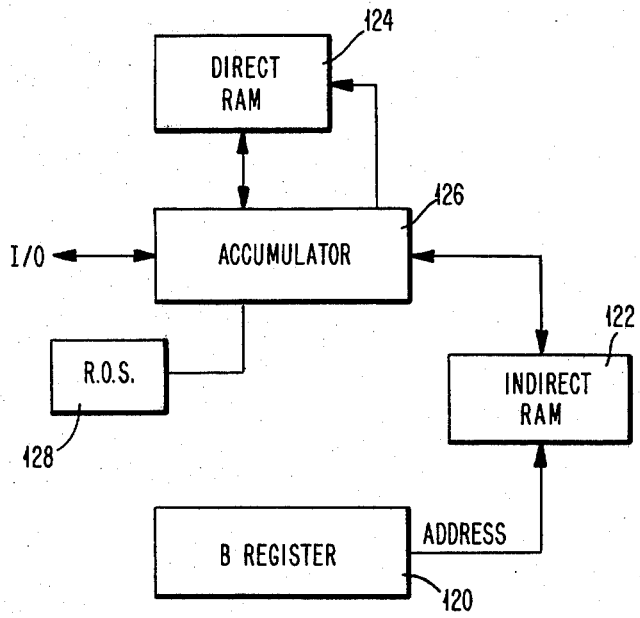
FIG. 8 is a diagram showing the interrelations of a register, memories and accumulator which manipulate the data within the logic and which utilize the code contained in Appendixes A through D.

As an aid to understanding the description of the instructions reference should be made to FIG. 8 which is illustrative of the flow of the instruction between register 120, memories 122, 124 and accumulator 126.

Appendix B is the complete listing of a set of instructions which serve to control the processor and may be programmed or coded as desired in order to control the electronic processor. Particular embodiments of the code or instructions may be modified as desired by one skilled in the art to accomplish the particular function of the invention. Additionally it should be recognized that a programmable processor may embody a program which may be written conforming to the requirements of that processor for accomplishing the same result.

Referring to Appendix B, Column 1 is the address, in hexadecimal code, where that particular instruction is stored. Column 2 represents the hexadecimal code for the instruction and is stored in the location designated by the corresponding information in Column 1. Column 3 is the mnemonics identifying the start point of particular sub-routines.

Column 4 is the mnemonics for the instruction which the processor then executes. Column 5 contains mnemonics which then, through definitions and equality statements in Appendix A assigns numerical values for registers or bits as appropriate for the instructions contained in Column 4. Column 6 are explanatory comments.

Appendix C includes a listing of instructions, the nmemonics representing these instructions and two columns designated respectively first byte and second byte, having also bit positions indicated numerically.

With reference to those bytes illustrated in the two byte columns, these bytes represent how that particular instruction would appear in the read only storage 128. The ones and zeros in those bytes are dedicated values which remain unchanged for that particular instruction while the B contained in the instruction code indicates the bits to be tested and the A's are representative of the address to which the instruction series will branch upon the meeting of particular conditions set forth, depending upon whether the bits B are represented by a 1 to 0. Referring to other instructions, the letter D represents a fixed value in memory and is determined by the individual implementing the particular device.

The R's are representative of the numerical designation for 1 of 32 separate registers which are available for storage of data and which are available to the processor.

Appendix D includes an instruction summary which lists the mnemonic, the name of the instruction represented by the mnemonic and a brief description of the function performed by the processor as a result of that particular instruction.

As an aid to understanding the description of the instructions contained in Appendix D, reference should be made to FIG. 8 which is illustrative of the flow of the instructions between register 120, memories 122, 124 and accumulator 126 together with read only storage 128.

While the invention has been particularly shown and described with reference to preferred embodiments thereof, it will be understood by those skilled in the art that the foregoing and other changes in form and details may be made therein without departing from the spirit and scope of the invention.

APPENDIX A

| | | |
|---|---|---|
| LCNT | EQUALS 2 | ADDRESS OF PRESENT CARRIER POSITION |
| MINI | EQUALS 3 | SUBADDRESS OF PRESENT CARRIER POSITION |
| MLCNT | EQUALS 4 | MEMORY LINE COUNT, ADDRESS LINE MEMORY |
| FLAG | EQUALS 10 | REGISTER IN WHICH DECISIONS BIT ARE STORED |
| WK2 | EQUALS 11 | WORKING REGISTER |
| WK3 | EQUALS 12 | WORKING REGISTER |
| WK4 | EQUALS 13 | WORKING REGISTER |
| WK5 | EQUALS 14 | WORKING REGISTER |
| WK6 | EQUALS 15 | WORKING REGISTER |
| EREG | EQUALS 17 | REGISTER THAT CONTAINS TEMPORARY ESCAPEMENT VALUE |
| KBD | EQUALS 5 | KEYBOARD REGISTER |
| KBDBLS | EQUALS 255 | KEYBOARD BUFFER BAILS STORAGE |
| PM | EQUALS 6 | PRINTER MAGNET REGISTER, REPRESENTS OUTPUT TO PRINTER |
| REVMAG | EQUALS 1 | REVERSE MAGNET |
| FWDMAG | EQUALS 2 | FORWARD MAGNET |
| ESCMAG | EQUALS 3 | ESCAPE MAGNET |
| SENSOR | EQUALS 7 | REGISTER THAT CONTAINS INPUT SENSORS |
| EMT | EQUALS 2 | EMITTER REPRESENTS ONE UNIT OF ESCAPEMENT |
| ECNT | EQUALS 8 | UNITS OF ESCAPEMENT REGISTER |
| WK1 | EQUALS 9 | WORKING REGISTER |
| ESCTABL | EQUALS 100 | TABLE THAT CONTAINS ESCAPEMENT VALUES OF CHARACTERS |
| VELTABL | EQUALS 200 | TABLE THAT CONTAINS VELOCITY VALUE OF CHARACTERS |
| ERTAPE | EQUALS 3 | ERASE TAPE LIFT MAGNET |
| VELMAG | EQUALS 4 | MAGNET THAT SELECTS VELOCITY OF IMPACT |
| CHARMAG | EQUALS 5 | MAGNET THAT SELECTS CHARACTER |
| STRB | EQUALS 0 | STROBE CHARACTER IN KEYBOARD BUFFER |
| B1 | EQUALS 0 | FIRST BAIL FROM KEYBOARD |
| B2 | EQUALS 1 | SECOND BAIL FROM KEYBOARD |
| B3 | EQUALS 2 | THIRD BAIL FROM KEYBOARD |
| LINUND | EQUALS 1 | LINE UNDERSCORE FLAG |
| RETURN | EQUALS 2 | RETURN BIT IN FLAG REGISTER |
| RET2 | EQUALS 3 | RETURN BIT IN FLAG REGISTER |

APPENDIX B

| | | | | |
|---|---|---|---|---|
| 0000 87 | START | LR | SENSOR | LOOK FOR INPUT |
| 0001 E000 | | TJN | STRB,START | |
| 0003 ABFF | | LBD | KBDBLS | LOAD INPUT |
| 0005 B0 | | LN | 0 | |
| 0006 05 | | STR | KBD | IS THE KEYBOARD INPUT A CHARACTER? |
| 0007 C01B | | TJE | B1,S1 | |
| 0009 C41B | | TJE | B2,S1 | |
| 000B C81B | | TJE | B3,S1 | |
| 000D AB90 | | LBD | X'90' | IS KEYBOARD INPUT A LINE UNDERSCORE |
| 000F 401F | | CJE | S2 | |
| 0011 ABA8 | | LBD | X'A8' | IS KEYBOARD INPUT AN UNDERSCORE COMMAND? |
| 0013 4042 | | CJE | UNDSCR | |
| 0015 ABF0 | | LBD | X'F0' | IS KEYBOARD INPUT AN ERASE COMMAND? |
| 0017 410A | | CJE | ERASE | |
| 0019 2153 | | BR | OTHERS | |
| 001B A4 | S1 | LBR | MLCNT | STORE CHARACTER INTO LINE MEMORY |
| 001C A8 | | STN | 0 | |
| 001D 2027 | | BR | PRCHAR | |
| 001F AAFC | S2 | LDH | X'FC' | STORE SPECIAL CODE INTO LINE MEMORY |
| 0021 A4 | | LBR | MLCNT | |
| 0022 A8 | | STN | 0 | |
| 0023 8A | | LR | FLAG | SET LINE UNDERSCORE FLAG |
| 0024 59 | | SBS | LINUND | |
| 0025 2000 | | BR | START | |
| 0027 85 | PRCHAR | LR | KBD | SET TILT AND ROTATE MAGNET |
| 0028 05 | | STR | CHARMAG | |
| 0029 A5 | | LBR | KBD | |
| 002A B0 | | LN | VELTABL | PRINT CHARACTER |
| 002B 04 | | STR | VELMAG | |
| 002C A5 | | LBR | KBD | FIND ESCAPE VALUE |
| 002D B0 | | LN | ESCTABL | |
| 002E 08 | | STR | ECNT | |
| 002F 86 | | LR | PM | START CARRIER MOTION |
| 0030 5A | | SBS | FWDMAG | |
| 0031 5B | | SBS | ESCMAG | |
| 0032 87 | PR1 | LR | SENSOR | IS EMITTER PRESENT? |
| 0033 E832 | | TJN | EMT,PR1 | |
| 0035 88 | | LR | ECNT | |
| 0036 AF | | S1 | | |
| 0037 08 | | STR | ECNT | |
| 0038 A0 | | LBR | X'0' | IS CARRIER THERE YET? |
| 0039 403D | | CJE | PR2 | |

APPENDIX B-continued

| | | | | |
|---|---|---|---|---|
| 003B 2032 | | BR | PR1 | |
| 003D 86 | PR2 | LR | PM | STOP CARRIER |
| 003E 52 | | RBS | FWDMAG | |
| 003F 53 | | RBS | ESCMAG | |
| 0040 2000 | | BR | START | |
| 0042 82 | UNDSCR | LR | LCNT | STORE PRESENT CARRIER POSITION |
| 0043 09 | | STR | WK1 | |
| 0044 83 | | LR | MINI | |
| 0045 0B | | STR | WK2 | |
| 0046 A4 | UN7 | LBR | MLCNT | PULL CHARACTER OUT OF MEMORY |
| 0047 B0 | | LN | 0 | |
| 0048 ABF8 | | LBD | X'F8' | CHARACTER A SPACE? |
| 004A 4075 | | CJE | UN1 | |
| 004C ABFA | | LBD | X'FA' | CHARACTER A TAB? |
| 004E 4075 | | CJE | UN1 | |
| 0050 ABFC | | LBD | X'FC' | CHARACTER A LINE UNDERSCORE CODE? |
| 0052 408E | | CJE | UN2 | |
| 0054 57 | UN3 | RBS | 7 | RESET EIGHTH BIT IN MEMORY |
| 0055 A4 | | LBR | MLCNT | STORE CHARACTER |
| 0056 A8 | | STN | 0 | |
| 0057 5F | | SBS | 7 | FIND ESCAPE VALUE OF THE CHARACTER |
| 0058 AE | | A1 | | |
| 0059 B0 | | LN | ESCTABL | |
| 005A 11 | | STR | EREG | |
| 005B 75 | UN6 | LDL | 5 | |
| 005C 03 | | STR | MINI | |
| 005D 83 | | LR | MINI | DECREMENT STORED CARRIER POSITION |
| 005E AF | | S1 | | |
| 005F 03 | | STR | MINI | |
| 0060 AB00 | | LBD | X'0' | |
| 0062 406B | | CJE | UN4 | |
| 0064 91 | | LR | EREG | |
| 0065 AF | | S1 | | |
| 0066 11 | | STR | EREG | |
| 0067 AB00 | | LBD | X'0' | |
| 0069 4070 | | CJE | UN5 | |
| 006B 82 | UN4 | LR | LCNT | DECREMENT CHARACTER COUNT |
| 006C AF | | S1 | | |
| 006D 02 | | STR | LCNT | |
| 006E 205B | | BR | UN6 | |
| 0070 84 | UN5 | LR | MLCNT | DECREMENT MEMORY FOR NEXT CHARACTER |
| 0071 AF | | | | |
| 0072 04 | | STR | MLCNT | |
| 0073 2046 | | BR | UN7 | |
| 0075 8A | UN1 | LR | FLAG | LINE UNDERSCORE? |
| 0076 E495 | | TJN | LINUND, PLAYOUT | |
| 0078 85 | | LR | KBD | |
| 0079 ABF8 | | LBD | X'F8' | SPACE? |
| 007B 405B | | CJE | UN6 | |
| 007D 84 | | LR | MLCNT | A TAB IS DETECTED |
| 007E AF | | S1 | | |
| 007F 04 | | STR | MLCNT | PLACE CARRIER POSITION IN MEMORY INTO |
| 0080 A4 | | LBR | MLCNT | A REGISTER |
| 0081 B0 | | LN | 0 | |
| 0082 03 | | STR | MINI | |
| 0083 84 | | LR | MLCNT | |
| 0084 AF | | S1 | | |
| 0085 04 | | STR | MLCNT | |
| 0086 A4 | | LBR | MLCNT | |
| 0087 B0 | | LN | 0 | |
| 0088 02 | | STR | LCNT | |
| 0089 84 | | LR | MLCNT | |
| 008A AF | | S1 | | |
| 008B 04 | | STR | MLCNT | |
| 008C 2046 | | BR | UN7 | |
| 008E 8A | UN2 | LR | FLAG | LINE UNDERSCORE? |
| 008F C495 | | TJE | LINUND, PLAYOUT | |
| 0091 A4 | | LBR | MLCNT | NO, CONTINUE |
| 0092 B0 | | LN | 0 | |
| 0093 2054 | | BR | UN3 | |
| 0095 89 | PLAYOUT | LR | WK1 | SAVE CARRIER RETURN POSITION |
| 0096 0C | | STR | WK3 | |
| 0097 8B | | LR | WK2 | |
| 0098 0D | | STR | WK4 | |
| 0099 89 | P1 | LR | WK1 | CALCULATE DISTANCE TO TRAVEL BACK |
| 009A AF | | S1 | | |
| 009B 09 | | STR | WK1 | |
| 009C 82 | | LR | LCNT | |
| 009D AF | | S1 | | |
| 009E 02 | | STR | LCNT | |

APPENDIX B-continued

| | | | | |
|---|---|---|---|---|
| 009F AB00 | | LBD | X'0' | WK1 CONTAINS LARGE DISTANCE |
| 00A1 40A5 | | CJE | P2 | |
| 00A3 2099 | | BR | P1 | |
| 00A5 8B | P2 | LR | WK2 | |
| 00A6 AE | | A1 | | |
| 00A7 AE | | A1 | | |
| 00A8 AE | | A1 | | |
| 00A9 AE | | A1 | | |
| 00AA AE | | A1 | | |

APPENDIX C

| INSTRUCTION | MNEUMONIC | FIRST BYTE 8 7 6 5 4 3 2 1 | SECOND BYTE 8 7 6 5 4 3 2 1 |
|---|---|---|---|
| TEST BIT-JUMP EQUAL | TJE | 1 1 0 B B B A A | A A A A A A A A |
| TEST BIT-JUMP NOT EQUAL | TJN | 1 1 1 B B B A A | A A A A A A A A |
| COMPARE-JUMP EQUAL | CJE | 0 1 0 0 A A A A | A A A A A A A A |
| COMPARE-JUMP LESS | CJL | 0 1 1 0 A A A A | A A A A A A A A |
| BRANCH | BR | 0 0 A A A A A A | A A A A A A A A |
| LOAD DIRECT LOW | LDL | 0 1 1 1 D D D D | |
| LOAD DIRECT HIGH | LDH | 1 0 1 0 1 0 1 0 | D D D D D D D D |
| LOAD REGISTER | LR | 1 0 0 R R R R R | |
| LOAD INDIRECT | LN | 1 0 1 1 A A A A | |
| LOAD B DIRECT | LBD | 1 0 1 0 1 0 1 1 | D D D D D D D D |
| STORE REGISTER | STR | 0 0 0 R R R R R | |
| STORE INDIRECT | STN | 1 0 1 0 1 0 0 0 | |
| SET BIT AND STORE | SBS | 0 1 0 1 1 B B B | |
| RESET BIT AND STORE | RBS | 0 1 0 1 0 B B B | |
| INCREMENT | A1 | 1 0 1 0 1 1 1 0 | |
| DECREMENT | S1 | 1 0 1 0 1 1 1 1 | |
| NO OPERATION | NOP | 1 0 1 0 1 1 0 1 | |
| EMITTER | ER | 1 0 1 0 1 0 0 1 | |

APPENDIX D

Instruction Summary

| Mnemonic | Name | Description |
|---|---|---|
| TJE B,A | Test Bit-Jump Equal | Test bit B in the accumulator and when on, branch to A. |
| TJN B,A | Test Bit-Jump Unequal | Test bit B in the accumulator and when off branch to A. |
| CJE R,A | Compare-Jump Equal | Compare byte R in B register with accumulator and when equal branch to A. |
| CJL R,A | Compare-Jump Low | Compare accumulator to byte R in B register and when accumulator is less than P branch to A. |
| BR A | Branch | Branch to A. |
| J A | Jump | Jump to A. |
| LDL D | Load Direct Low | Load low half of the accumulator from the instruction. Zero high half. |
| LDH D | Load Direct | Load the accumulator from the instruction. |
| LR R | Load Register | Load accumulator from direct memory. Place direct memory address in storage address Register. |
| LBR R | Load B Register | Load the B Register from direct memory. |
| LN A | Load Indirect | Load the accumulator from indirect memory. (Address given by B Register and 4 bits of the instruction.) |
| STR R | Store Regsiter | Store the accumulator in direct memory. Place direct memory address. |
| STN | Store Indirect | Store the accumulator in indirect memory (Address in Register.) |
| SBS B | Set Bit and Store | Set bit B in direct memory (address in Storage Address Register) to 1. |
| RBS B | Reset Bit and Store | Set bit B in direct memory (address in Storage Address Register) to 0. |
| A1 | Increment | Add one to the accumulator. |
| S1 | Decrement | Subtract one from the accumulator |
| NOP | No Operation | Go to next instruction. |

APPENDIX D-continued

| Instruction Summary | | |
|---|---|---|
| Mnemonic | Name | Description |
| ER | Emitter Reset | Reset Emitter latch. |

We claim:

1. A method of erasing characters of a width greater than an underscore and said underscore on a typewriter having printing means for selecting and printing proportionally spaced characters of varying widths, said characters including an underscore;

said printing means operable to print sequentially in response to commands from a keyboard and including means for erasing said characters and underscores;

said typewriter having electronic controls and proportional escapement capabilities and responsive to electronic commands;

said method comprising the steps of:

generating codes indicative of said keyboard commands and characters;

providing an alterable memory means including means for storing said codes indicative of said keyboard commands and said characters;

storing said codes in said memory means in response to said keyboard commands;

actuating said printing means to effect selection and printing of said characters and underscores in accordance with said generated codes;

moving said printing means in a forward direction, in response to said keyboard commands and in accordance with the amount of distance for selected ones of said keyboard commands in accordance with predetermined amounts of width of said characters associated with said keyboard commands;

altering said codes stored in said memory means upon the printing of an underscore, to indicate the existance of an underscore;

generating an erase signal to initiate an erase sequence of operations comprising:

reading said codes stored in said alterable memory means in reverse order of storage in response to said erase signal;

determining whether a character represented by said code is underscored;

commanding a reverse movement of said printing means;

determining the width of movement associated with said codes stored individually in reverse order of storing in said memory means in response to said erase signal;

determining the width of movement associated with said underscore where said altered codes represents an underscored character in response to said erase signal;

determining the least width of movement associated with said underscore and said character which is represented by said altered code;

moving said printing means in reverse direction in response to said commanding a reverse movement, a width of movement determining as said least width;

obliterating said underscore;

determining the excess of width of movement associated with the character represented by said code over the width of movement associated with said underscore, if any, moving said printing means in reverse direction a width equal to said excess of width;

obliterating the remainder of said underscore;

obliterating said character represented by said altered code, whereby characters having a proportionally spaced relation to other characters, wider than the width of an underscore may be erased along with the underscore without leaving residual portions of said underscore.

* * * * *